US011982025B2

(12) United States Patent
Karaduman et al.

(10) Patent No.: US 11,982,025 B2
(45) Date of Patent: May 14, 2024

(54) WARPING MACHINE FOR A ROPE AND CORRESPONDING METHOD

(71) Applicant: CALIK DENIM TEKSTIL SAN. VE TIC. A.S., Istanbul (TR)

(72) Inventors: Ahmet Serhat Karaduman, Yesilyurt/Malatya (TR); Abdullah Dagdelen, Battalgazi/Malatya (TR); Haci Huseyin Tural, Yesilyurt/Malatya (TR); Munevver Ertek Avci, Yesilyurt/Malatya (TR); Tarik Buyukikiz, Yesilyurt/Malatya (TR)

(73) Assignee: Calik Denim Tekstil San. Ve Tic. A.S., Istanbul (TR)

( * ) Notice: Subject to any disclaimer, the term of this patent is extended or adjusted under 35 U.S.C. 154(b) by 1191 days.

(21) Appl. No.: 16/620,807

(22) PCT Filed: Jun. 9, 2017

(86) PCT No.: PCT/EP2017/064180
§ 371 (c)(1),
(2) Date: Dec. 9, 2019

(87) PCT Pub. No.: WO2018/224173
PCT Pub. Date: Dec. 13, 2018

(65) Prior Publication Data

US 2020/0173064 A1 Jun. 4, 2020

(51) Int. Cl.

| | |
|---|---|
| ***D02H 3/00*** | (2006.01) |
| ***D02H 13/26*** | (2006.01) |
| *D02H 13/24* | (2006.01) |

(52) U.S. Cl.
CPC ..... *D02H 3/00* (2013.01); *D02H 13/24* (2013.01); *D02H 13/26* (2013.01)

(58) Field of Classification Search
CPC ..... D02H 3/00; D02H 13/26; D02H 13/22; D02H 13/00; D02H 5/00; D02H 13/12;
(Continued)

(56) References Cited

U.S. PATENT DOCUMENTS 463,415 A 11/1891 Brown
504,459 A * 9/1893 Rhoades ..... D02H 3/00 28/194

(Continued)

FOREIGN PATENT DOCUMENTS

CN 2709467 Y 7/2005
CN 104313752 A 1/2015

(Continued)

OTHER PUBLICATIONS

English language translation (machine translation) of KR 20010066415; Baek; Pub Jul. 2001 (Year: 2001).*

(Continued)

*Primary Examiner* — Amy Vanatta
(74) *Attorney, Agent, or Firm* — Banner & Witcoff Ltd.

(57) ABSTRACT

The invention relates to a warping machine (1) for a rope (3) made of a plurality of yarns (5), comprising a support structure (25), a bobbin (9) onto which said rope is warped, wherein said bobbin is mounted on the support structure for rotating around a rotational bobbin axis ($R_1$) of the bobbin, and a pressure drum (31) rotatably mounted on the support structure for rotating around a rotational drum axis ($R_2$) for applying pressure onto the rope warped onto the bobbin, wherein said rotational bobbin axis is supported stationary with regard to said support structure and said rotational drum axis is translationally movably mounted on the support structure so that the pressure drum follows an increasing warp thickness on the bobbin.

17 Claims, 5 Drawing Sheets

(58) Field of Classification Search
CPC ..... D02H 13/16; D02H 13/18; D02H 13/20; D02H 13/10; D02H 13/28; D02H 13/24; D02H 7/00
USPC ..... 28/196, 197
See application file for complete search history.

(56) References Cited

U.S. PATENT DOCUMENTS 631,876 A * 8/1899 McTaggart ..... D02H 3/00 28/194
756,014 A 3/1904 Goodwin
774,696 A * 11/1904 Rhoades ..... D02H 3/00 28/195
1,488,516 A * 4/1924 Rhoades ..... D02H 3/00 28/197
1,892,507 A * 12/1932 Frohlich ..... D02H 13/16 28/214
2,033,738 A * 3/1936 Reiners ..... D02H 3/00 28/195
2,037,512 A * 4/1936 Kahlisch ..... D02H 3/00 28/195
2,446,580 A * 8/1948 Garden ..... D02H 3/00 28/200
2,940,687 A * 6/1960 Mason ..... D02H 3/00 242/482.9
3,457,612 A * 7/1969 Gorum ..... D02H 13/16 28/212

FOREIGN PATENT DOCUMENTS

DE 905240 C 3/1954
JP 2012111586 A * 6/2012
KR 20010066415 A 7/2001

OTHER PUBLICATIONS

PCT International Searach Report dated Apr. 12, 2018, for Application No. PCT/EP0217/064180.

* cited by examiner

WARPING MACHINE FOR A ROPE AND CORRESPONDING METHOD

CROSS REFERENCE TO RELATED APPLICATIONS

This patent application is a U.S. National Stage patent application of International Application No. PCT/EP2017/064180, filed Jun. 9, 2017, which is incorporated herein by reference in its entirety.

BACKGROUND

Field

The present disclosure relates to a warping machine or winding machine for a rope onto a drum, particularly a so-called bobbin. Such machines are generally known in the relevant technical fields as ball warpers. The rope consists of a plurality of yarns, particularly more than 200 yarns, more particularly between 300 to 600 yarns, particularly made of cotton, which are bundled, twisted, braided and/or wrapped together. Each yarn can comprise of a plurality of fibers, particularly more than 200 fibers, more particularly between 300 to 600 fibers, particularly made of cotton, bundled, twisted, braided and/or wrapped together. The disclosure also relates to a method of warping of such a rope onto a bobbin, which is known as ball warping.

Related Art

In known rope warping machines, which are for example illustrated on the homepage of the manufacturer Morrison Textile Machinery Inc., a frame structure supports the bobbin and a pair of drums arranged for being in pressure contact with the rope warped onto the bobbin on the ground, wherein the bobbin and the pair of drums are rotatably mounted on the frame structure. The pair of drums is driven by a motor cooperating with a transmission for transmitting the force generated by the motor to each drum. The pair of driven drums is arranged below the bobbin wherein each rotational drum axis is stationary with regard to the frame structure. Each drum is in contact with the bobbin, respectively the rope warped onto the bobbin, wherein each contact area is defined by the peripheral surfaces of the drums and the bobbin. The rotational axes of the driven drums are offset with respect to each other in a direction defined by a conveying direction of the rope, wherein the offset needs to be bigger than the sum of the radius of both drums, which requires a lot of space, particularly in a horizontal direction.

The bobbin is supported on the frame structure in a way that the weight of the bobbin executes a pressure onto the driven drums such that due to the resulting friction between the bobbin and the drums, the bobbin is turned in accordance with the rotation of the driven drums. The pressure acting between the drums and the bobbin is conclusively defined by the mass of the bobbin and gravity. In order to drive the bobbin, it is necessary for the bobbin to be exactly in line with the pair of driven drums along its entire width so that the force transmission from each drum is evenly distributed over the whole width of each drum and the bobbin. During the process of winding the rope onto the bobbin, the diameter of the bobbin increases due to the increasing number of layers of rope lying on top of each other and surrounding the bobbin. In order to compensate the increasing warp thickness on the bobbin and as a result of the drums being stationary with regards to the frame structure, the bobbin, respectively the rotational bobbin axis, is movable with regard to the frame structure. It is therefore necessary to provide a guiding device for moving the bobbin with regards to the frame structure, respectively with regard to the pair of driven drums, in a radial direction of the drums. As according to the known rope warping machines the drums are horizontally displaced with their rotational axes being located at the same vertical height with regard to the ground, the guiding device must be designed in a way to move the bobbin in a vertical direction.

Another disadvantage of said arrangement of one pair of driven drums cooperating with the free turning bobbin is that the rope and its yarns are likely to be damaged due to the increasing pressure caused by the increasing weight of the bobbin and the rope being warped onto the bobbin. Furthermore, this can also lead to a damage of the motor driving the drums because the motor needs to produce an increasing amount of driving force in order to counteract the increasing weight of the bobbin respectively friction between the bobbin and the drums. In order to overcome said problem, a motor with more power which will require more space and which will be more expensive can be used.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 4A:
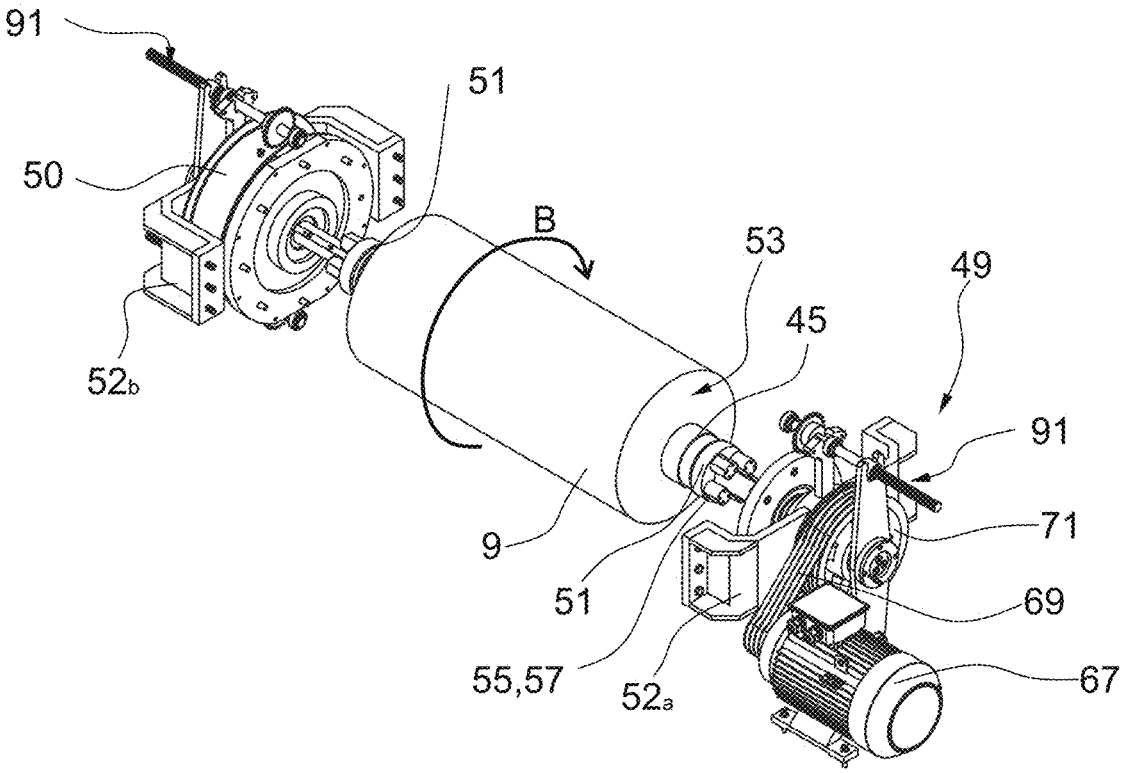
Figure 4B:
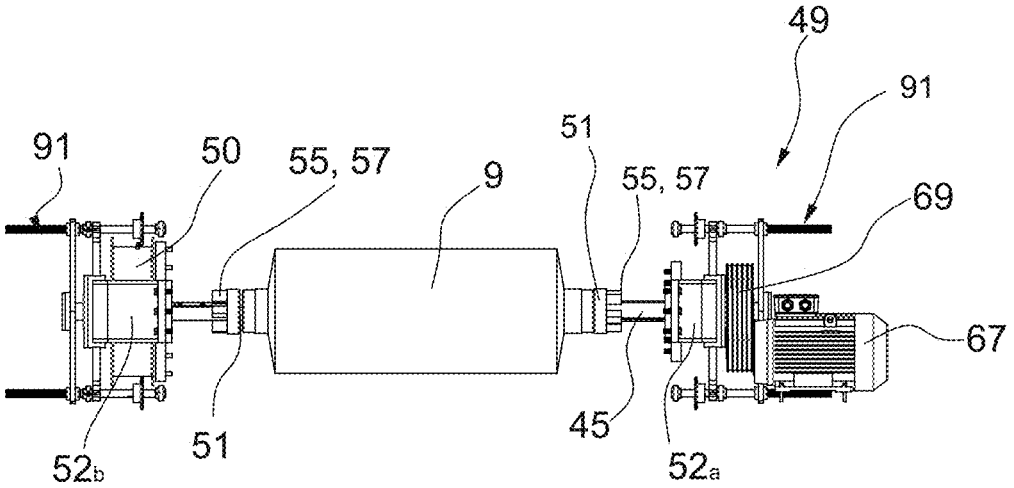

FIG. 4*a* shows a perspective view of a drive according to an exemplary embodiment for rotating a bobbin;

FIG. 4*b* shows a side view of the bobbin drive according to FIG. 4*a;*

Figure 5A:
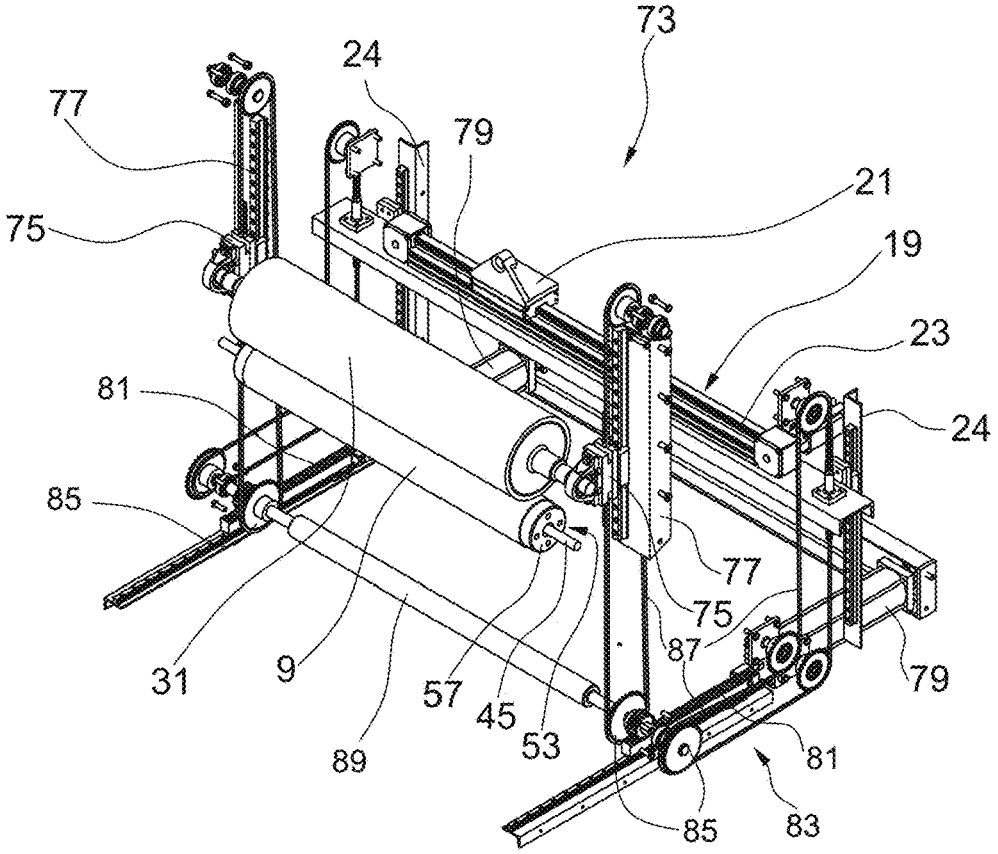
Figure 5B:
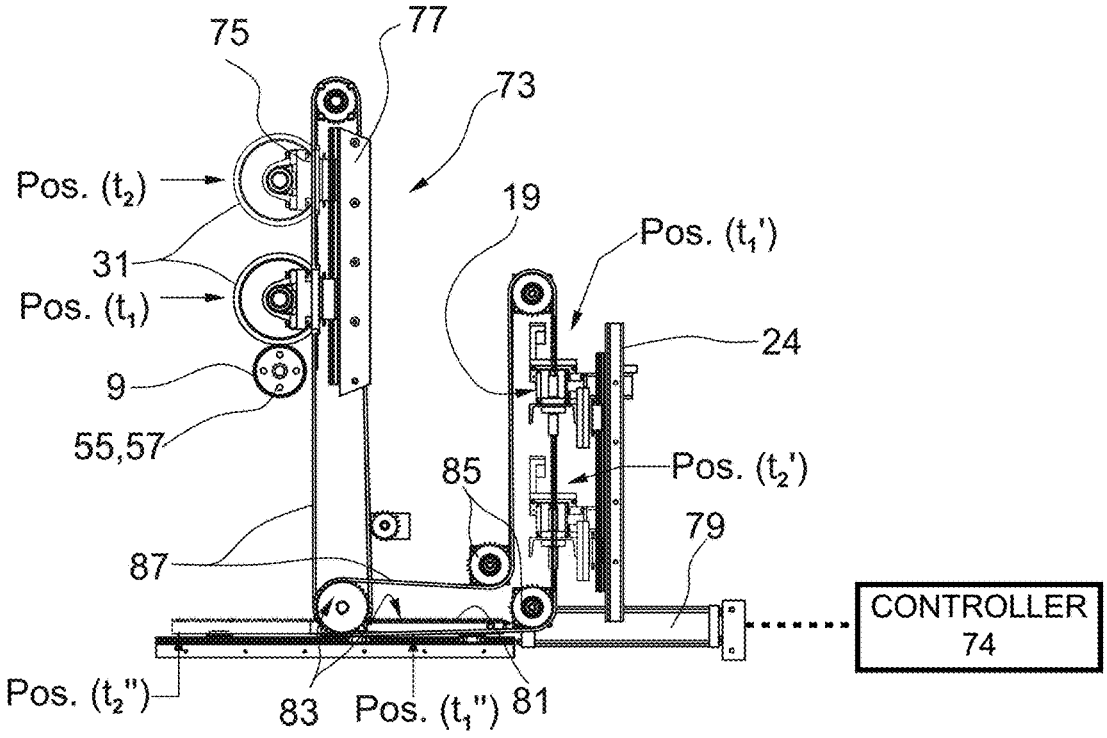

FIG. 5*a* shows a perspective view of a guiding device according to an exemplary embodiment for moving a rope guide and a pressure drum with regards to a frame structure;

FIG. 5*b* shows a side view of the guiding device according to FIG. 5*a;*

Figure 6A:
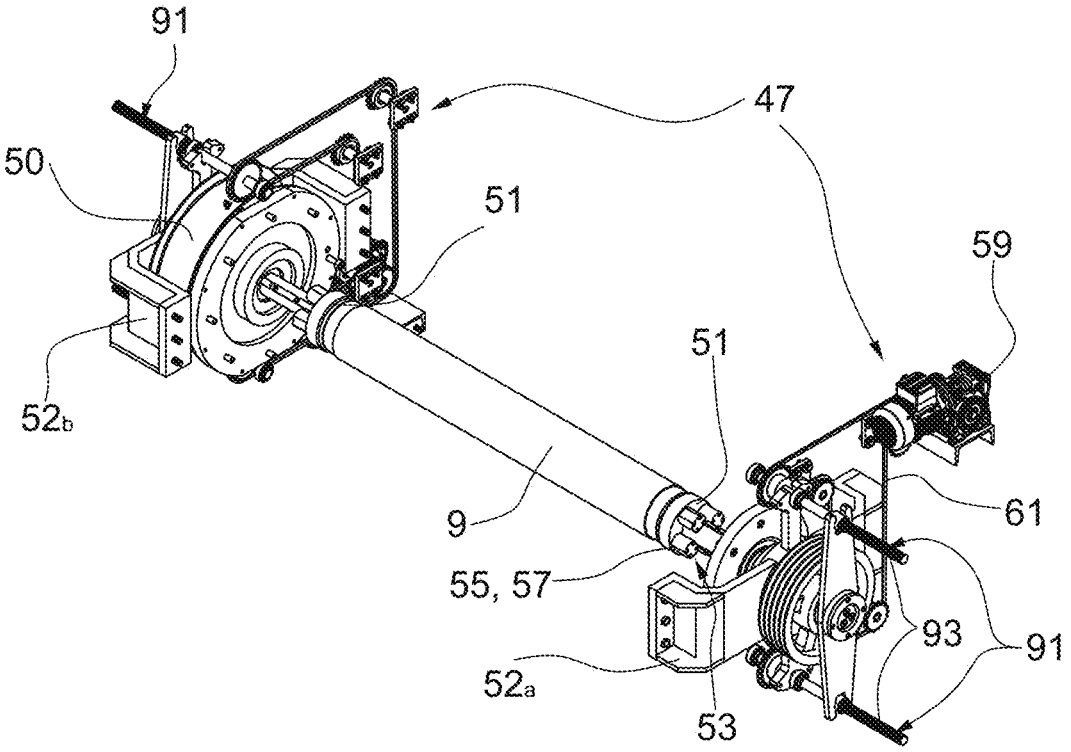
Figure 6B:
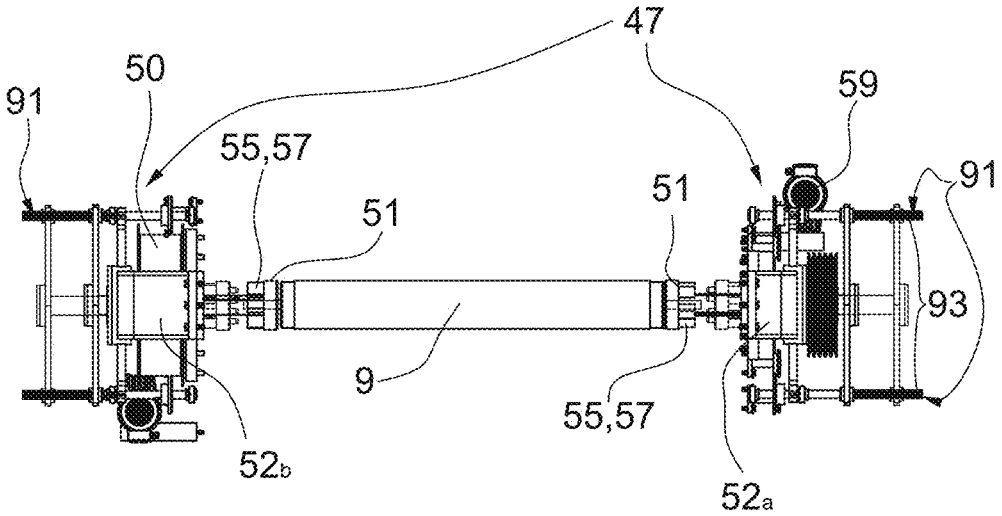

FIG. 6*a* shows a perspective view of an engagement device according to an exemplary embodiment for positioning and engaging the bobbin with the drive; and FIG. 6*b* shows a side view of the engagement device according to FIG. 6*a*.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to overcome the above-mentioned disadvantages of the state of the art, particularly to provide a rope warping machine where damage on the rope warped onto the bobbin is prevented or at least minimized. Preferably, the rope warping machine according to the present disclosure shall be easy to assemble and have a compact design. It is a further object of the present disclosure to provide a method for warping a rope onto to a bobbin in accordance with the described machine.

According to the disclosure, a warping or winding machine for warping and/or winding a rope onto a drum is provided. The drum, particularly a so-called bobbin, is preferably cylindrically shaped and arranged at a support structure of the warping machine for rotating around a rotational bobbin axis in order to receive the rope and to warp or wind the rope onto said bobbin. The rope can comprise a plurality of yarns bundled, twisted, braided and/or wrapped together, wherein each yarn can comprise a plurality of fibers, particularly made of cotton, which fibers are also bundled, twisted, braided and/or wrapped together. Further, a pressure drum is rotatably mounted on the support structure and is arranged on the support structure such that the pressure drum contacts the bobbin and particularly applies a predefined pressure to the rope wound onto the bobbin in order to control the winding action of the rope onto the bobbin. In a preferred embodiment, the pressure drum comprises an essentially cylindrical shape, wherein particularly a peripheral, particularly cylindrical surface of the pressure drum contacts a peripheral surface of the bobbin. The contact of the pressure drum and the bobbin as well as the wound rope is essentially linear or a small surface strip. The pressure drum and the bobbin are configured to roll alongside each other.

Preferably, the rotational shape of the bobbin and the rotational shape of the pressure drum are aligned with respect to each other such that a linear contact between their peripheral surfaces is ensured, preferably along the entire winding width of the bobbin, the width being defined in axial direction of the bobbin. As soon as rope material is warped onto the bobbin, the peripheral surface of the pressure drum is in contact with the rope material, wherein particularly the pressure drum is configured to apply a predefined pressure onto the rope warped onto the bobbin in order to smoothen the warping surface of the bobbin and to reduce the warping thickness on the bobbin. Preferably, the pressure is dominated by only the weight of the pressure drum.

The warping machine according to the disclosure comprises a support structure that is to be fixed onto the ground or to a wall of planned handling the process of roping. The support structure in general shall be as stable to carry the bobbin, the pressure drums, bearings for said elements, motors, gear arrangements, transmissions for moving the bobbin and/or the pressure structure. The support structure can comprise preferably two sideframes or -walls of preferably identical shape arranged opposite to each other and stationary with regard to the ground and/or to the a machine bottom, wherein particularly at least one supporting bar for strengthening the support structure is fixedly attached to both sidewalls, particularly to both inner surfaces of the sideframes. It is clear, that the support structure carries or supports further components of the warping machine, such as for example a transmission or a motor. In order to make sure that the support structure maintains the machine in its position during operation, the support structure, preferably the sidewalls, is secured to the ground and/or the machine bottom.

According to a first aspect of the disclosure, the rotational bobbin axis is stationary with regards to the support structure, which means that during a warping operation, the location and orientation of the rotational by supported bobbin does not change and does not move with respect to the support structure. A pure rotational movement of the bobbin is allowed. It shall be clear that after the warping operation is finished, the bobbin can be removed from the support structure in order to be replaced by another bobbin for a further warping operation. As mentioned above, said pressure drum is also rotationally mounted to the support structure, however, its rotational drum axis is movably mounted to the support structure such that the pressure drum can follow an increasing warp thickness being formed on the stationary bobbin. The rotational drum axis follows a translational path which is predefined by the support mechanism of the rotational drum axis with respect to the support structure. Essentially translatory could be understood such that the rotational drum axis remains parallel to the rotational bobbin axis, wherein preferably it is to be considered that the warp thickness on the bobbin continuously increases along the warping width of the bobbin such a leading drum section contacts the warped rope before a trailing drum section. Therefore, during the warping operation, pressure drum along its rotational drum axis continuously builds up contact with the warped rope, wherein a leading drum contact section is increasing to the disadvantage of trailing drum section having still a clearance to the warped rope. The mounting of the pressure drum on the support structure shall prevent the pressure drum from tilting and ensures that the pressure drum is translationally moved (keeping to the rotational drum axis and rotational bobbin axis parallel to each other) depending on the increase of warp thickness on the bobbin. Said drum movement direction is thus defined by a radial direction of the bobbin with regards to the rotational bobbin and drum axis.

Preferably, the pressure being applied to the bobbin, respectively onto the rope lastly warped onto the bobbin, shall be essentially constant and should not be enhanced due to the increasing warp thickness on the bobbin. An increase of the weight of the bobbin, which might lead to an increased pressure to the rope should be avoided in order to not damage the rope. As the translationally movably mounted pressure drum follows the increasing warp thickness on the bobbin, the pressure drum is pushed away from the bobbin, respectively from the rotational bobbin axis, in a radial direction by the rope material. Preferably, the movable rotational drum is linked to a pressure generating mechanism which is controlled by a pressure regulation which preferably comprises a pressure sensor. The pressure applied to the bobbin and/or warped rope is controlled such that it remains constant during the warping operation. However, the pressure could be also set according to the warping thickness on the rope and particularly to increase the pressure along an increasing of warping thickness.

In a preferred embodiment, the rotational bobbin axis and the rotational drum axis are oriented essentially horizontal, wherein a movement of the rotational drum axis relative to the bobbin is essentially vertical. This means that the pressure drum is vertically movably mounted to the support structure.

A guiding device for moving the pressure drum in accordance with the increasing warp thickness on the bobbin can be provided. Said guiding device comprises a carriage-rail-arrangement which is fixedly and removably mounted to the support structure. In a preferred embodiment, the carriage-rail-arrangement comprises a carriage on which the pressure drum is rotatably and fixedly mounted. A bar, preferably a rail, is formed on said support structure or fixedly attached to the support structure and is configured to cooperate with the carriage, wherein the carriage is configured to relatively move with regards to the rail for guiding the pressure drum on a predefined path in accordance with the increasing warp thickness such that the carriage-rail-arrangement forces the carriage to follow a predetermined, preferably linear, guiding direction. Preferably, the orientation of the rail at the support structure defines the motion direction of the pressure drum, wherein in a preferred embodiment rail is essentially perpendicularly oriented on the support structure so that the pressure drum moves away from the bobbin essentially in a vertical direction.

The guiding device can further comprise a preferably pneumatically actuated drive system acting on the movable pressure drum for generating a pneumatic force which causes the pressure drum to apply pressure onto the bobbin. Therefore, the pressure acting on the bobbin, respectively the rope warped onto the bobbin, can be set by the drive system. The pneumatic force, respectively the pressure, is directed opposite to the increasing warp thickness, respectively the carriage movement, so that preferably a particularly constant pressure of at least 0.5 bar or 1 bar, preferably about 1.5 to 2.5 bar, can be applied on the bobbin and/or the rope warped onto the bobbin. The drive system can be equipped with a pressure sensor continuously measuring the pressure applied to the bobbin and/or the warped rope on the bobbin. Such a pressure sensor can be a part of a control system for continuously controlling the pressure applied to the bobbin according to the particularities of the rope and the material of the rope. A damage of the rope shall be prevented because the pneumatic force, respectively the pressure acting on the bobbin, does not exceed a critical threshold. Particularly, the drive system cooperates with the carriage such that the pressure drum follows the increasing warp thickness the bobbin and simultaneously applies pressure onto the bobbin. Therefore, it is constantly possible to apply a desired, preferably constant, pressure on the bobbin and at the same time guiding the pressure drum in accordance with the increasing warp thickness away from the bobbin.

Preferably, the drive system can be connected to a control device in order to regulate the amount of pressure such that during the following of the increasing warp thickness on the bobbin, the pressure drum applies particularly constant pressure of preferably at least 0.5 or 1 bar, more preferably about 1.5 bar to about 2.5 bar, onto the bobbin and/or the rope warped onto the bobbin. Therefore, it is ensured that the pressure does not exceed a critical level. In a further preferred embodiment, an operating program can be deposited on the control device for automatically regulating the pressure. A regulation process can thereby be based on input data relating to warping machine characteristics, such as a length of the rope, a diameter of the bobbin, or others.

The drive system can be coupled to at least one pneumatic cylinder which generates a pneumatic force. In order to transmit the pneumatic force to the pressure drum, a transmission can be provided. Said transmission can be a rack and pinion gear which comprises a rack connected to the pneumatic cylinder, a pinion designed for rolling alongside the rack and the chain rolling alongside said pinion. The transmission, preferably the rack and pinion gear, is thereby coupled to the pneumatic cylinder such that the pneumatic force of the pneumatic cylinder causes the rack to linearly move. As a result, the pinion is rotationally driven around its rotational axis by the rack and the chain is rotationally driven in accordance with the rotation of the pinion, wherein the chain is fixedly connected with the carriage in order to translationally move the pressure drum. In this way, the pressure drum can be guided along the support structure in order to follow an increasing warp thickness on the bobbin and to ensure a pressure amount not exceeding the critical level to prevent the rope from being damaged.

According to a further independent and/or additional aspect of the disclosure, a drive for rotationally driving said bobbin around its rotational bobbin axis is provided. The pressure drum is mounted at idle for freely turning around its rotational drum axis. Said bobbin is arranged (from a force transmission perspective) between said drive and said pressure drum such that the bobbin transfers rotational driving forces of said drive to the pressure drum. The pressure drum mounted at idle is only driven by the rolling-up-contact of the bobbin driven by said drive. No other driving force for generating the rotational movement of the pressure drum is foreseen. It turned out that the separation of the driving action to be transferred from the bobbin to the pressure drum on the one hand side and on the other hand the application of pressure from the pressure drum at idle to the bobbin surprisingly increases the quality of rope warping.

The drive preferably is directly coupled to said bobbin such that a drive force generated by the drive is directly introduced into and/or transferred to the bobbin for rotationally driving said bobbin around its rotational axis. It is possible that the bobbin is rotationally driven in one rotational direction with regard to the rotational bobbin axis, wherein in the other rotational direction the bobbin can freely rotate (e.g. is not driven). Alternatively, the drive can be designed to rotationally drive the bobbin into both rotational directions around the rotational bobbin axis, particularly to drive the warping machine in a reverse direction in order to unwind the rope from the bobbin. The fact that the pressure drum is at idle means that no separate drive is provided for rotating the pressure drum. Due to the pressure contact of the pressure drum with the bobbin, the existing friction between the peripheral surface of the pressure drum and the peripheral surface of the bobbin, respectively the warped rope material on the bobbin, causes the pressure drum to rotate around its rotational axis. Therefore, the rotation of the pressure drum is preferably exclusively realized by the frictional contact with the bobbin. In a preferred embodiment, the pressure drum can be movably mounted to the frame structure such that the rotational drum axis follows an increasing warp thickness on the bobbin, as described above. In a preferred embodiment, a force transmission point for transmitting the drive force from the drive to the bobbin is located at a rope-free surface of the bobbin onto which no rope is warped to. Preferably, the rope-free surface is defined by an end face of the bobbin, wherein particularly the end face is defined such that a normal vector of the end face is parallel to the rotational bobbin axis. Said kind of force transmission has the advantage that driving the bobbin is separate from warping the rope. Therefore, a more efficient driving of the bobbin in comparison to known warping machines is assured and a potential damage on the rope is minimized or even prevented.

The bobbin drive can comprise a motor for generating a drive force and a transmission, preferably a belt drive, coupled to the motor for transmitting the drive force to the bobbin. The motor can be of any suitable type, preferably a combustion engine, an electrically or pneumatically actuated motor. The bobbin can be configured to transfer the drive force to the pressure drum for rotating the pressure drum around its rotational axis by means of friction, wherein particularly said force transmission is performed by a frictional contact between a peripheral bobbin surface and a peripheral drum surface such that a bobbin rotating direction is directed opposite to a drum rotating direction.

Particularly, an engagement device couples the drive with the bobbin and/or a drive shaft of the bobbin axially protruding the bobbin. The drive shaft can be coaxially arranged with regard to the rotational bobbin axis. Preferably, a radial extension, particularly an outer diameter, of the drive shaft the smaller than a radial extension, preferably an outer diameter, of the bobbin.

In a preferred embodiment, the engagement device comprises an interlock, such as a wheel hub or a clutch, which is fixedly connected to the transmission of the drive. The interlock can form a force introduction point designed for engaging with a bobbin force transmission point. In a preferred embodiment, the interlock, preferably the wheel hub or clutch, is designed as a preferably round disc of rigid material, such as for example metal. More preferably, the interlock is arranged coaxially with regard to the rotational bobbin axis.

Further, a ball screw can be provided for guidingly moving the interlock in said rotational bobbin axis in order to engage/disengage the bobbin. This allows for an easy and quick exchange of bobbins, particularly when a warping operation is finished and a further bobbin shall be provided for another warping operation. Preferably, the force introduction point is defined by a nub or pin formed on a surface of the interlock facing a contact surface of the bobbin and is configured to engage with a corresponding notch defining the bobbin force transmission point, or vice versa, in order to provide a form-fitting force transmission. Alternatively or additionally, a contact surface of the bobbin and a surface of the interlock facing the bobbin contact surface are configured to frictionally engage each other in the manner of a coupling for transmitting the drive force. Preferably, the contact surface is defined by the rope-free surface of the bobbin, preferably being located at an end face of the bobbin.

According to another independent and/or additional aspect of the disclosure, a rope guide which is known in the technical field of rope warping as a traveler, is arranged upstream said bobbin and is movably supported with respect to the bobbin on the support structure for reciprocating and guiding said rope along a warping width of said bobbin. "Upstream" and/or "downstream" shall be defined by the unidirectional conveying direction of the rope onto the bobbin. Regarding the conveying direction, the rope guide is arranged upstream with respect to the bobbin, however, the tooling of the yarns to the rope shall be realized upstream the rope guide. The warping width is thereby defined by the width of the rope already wound onto the bobbin measured along said axial bobbin direction. A rotation of the bobbin causes a warping or winding operation of the rope onto the bobbin, respectively around the peripheral surface of the bobbin. The reciprocating movement of the rope guiding shall be fixed along the rotational drum axis, particularly parallel to the axial bobbin and/or drum direction, so that the rope is evenly (helically) distributed along essentially the entire width of the bobbin. When the rope guide, respectively the rope, reaches an axial end of the bobbin, such as an end face of the bobbin, the rope guide turns and starts moving back in the opposite direction to build up another layer of rope on the bobbin, thereby continuously increasing the warp thickness on the bobbin. It shall be clear, that the warping width might continuously vary between a minimum and a maximum due to the reciprocating movement of the rope guide. The maximal warping with is limited by the width of the bobbin. According to the disclosure, the rope guide is further (besides the reciprocating) movably supported with respect to the bobbin for moving away from said bobbin, particularly to follow an increase of warp thickness on the bobbin. The rope guide is further movably supported, particularly in a further unidirectional degree of freedom (that might be vertical to the reciprocating direction), to be movable in a radial direction with respect to the bobbin, preferably a vertical axis. The rope guide departs from the bobbin independent of the increase of rope thickness on the bobbin, particularly such that a feed string of said rope between the rope guide and the bobbin maintains its orientation with regard to the support structure and/or remains horizontally. A slight deviation from the horizontal plane is allowed, particularly when upon the following of the increasing warp thickness on the bobbin by the rope guide, the increase of the warp thickness and the away movement of the pressure drum are not performed exactly simultaneously, rather in a slight leading or trailing manner with respect to each other. This leads to a safe conveying of the rope and reduces the risk of damage. Therefore, said rope section between the rope guide and the bobbin is oriented such that the rope engages the bobbin at a 6 o'clock position on the circumference of the bobbin. Preferably, the rope guide is movable transverse, particularly perpendicular, with regard to a plane defined by the orientation of the feed string and the rotational bobbin axis.

Preferably, the rope guide is moved away from the bobbin along the frame structure by a preferably pneumatically actuated drive system, wherein particularly said drive system is the same drive system which is used for moving the pressure drum. According to a preferred aspect of the disclosure, said common drive system synchronizes the movement of the pressure drum and the movement of the rope guide such that they both follow an increasing warp thickness on the bobbin. Preferably, the rope guide and the pressure drum move in opposing radial directions, particularly vertical directions, with regard to the rotational bobbin axis. The movement of the pressure drum and the rope guide can also be synchronized in that they move simultaneously. Preferably, the distances covered by each of the pressure drum and the rope guide are equal. More preferably, the movement of the pressure drum and the rope guide can follow a predetermined clocking. It shall be clear, that suitable means, particularly a transmission in case of different movement distances, are also included by the disclosure of the present disclosure.

Preferably, the rope guide comprises a bar, preferably a rail, mounted to the support structure and a slide configured to receive and reciprocate the rope along the warping width of the bobbin such that the slide is relatively moved, particularly glided or rolled, with regard to the bar. The bar can be arranged translatory movable along a guide which is attached to the support structure for moving away from said rotational bobbin axis and preferably for defining a predetermined translatory moving direction for the rope guide. The guide can comprise an L-shape, wherein one of the legs of the L-shaped guide is configured for attaching to the support structure and the other of the legs is configured for guiding the bar of the rope guide along the support structure, similar to a carriage-rail-arrangement.

Further, the synchronization can be performed such that a rotational movement of the chain of the drive transmission correlates with a translatory movement of the pressure drum and the rope guide. Particularly the chain is connected with the carriage corresponding to the pressure drum and with the bar corresponding to the rope guide, wherein preferably the carriage and the bar are arranged at the chain such that a rotational turning point of the chain is positioned inbetween the carriage and the bar to translationally move them into different, preferably opposing, more preferably opposing vertical, directions. Preferably, the pinion around which the chain rotates defines the turning point.

It is noted that a method according to the disclosure can be defined such that it realizes the warping machine for a rope according to the disclosure, and vice versa.

Figure 1:
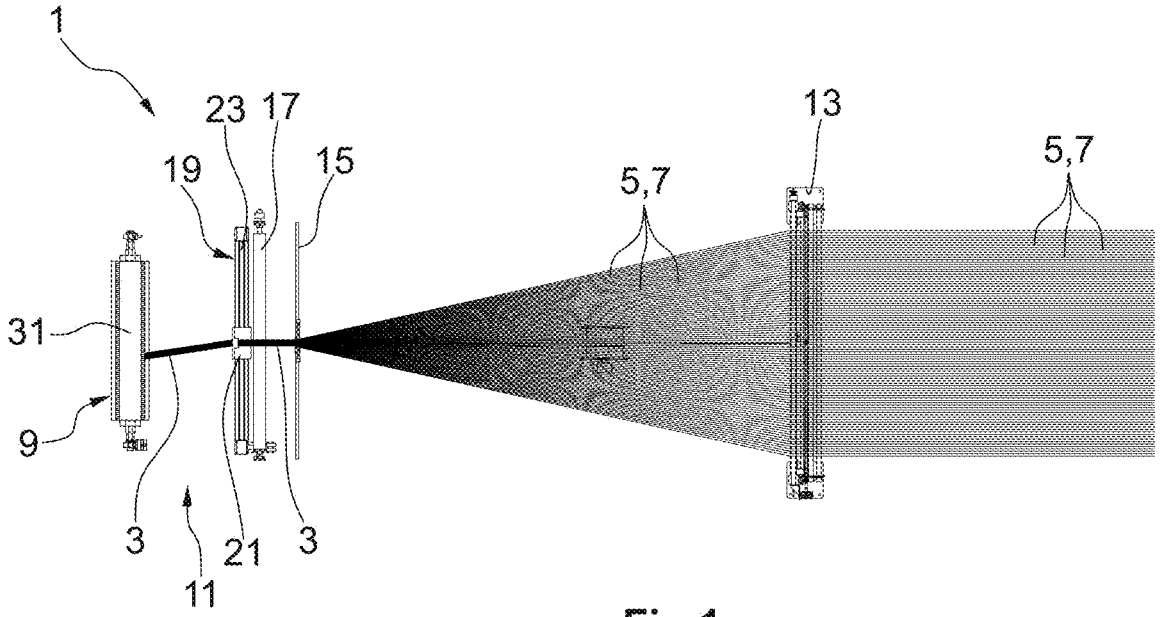
FIG. 1 shows a schematic diagram of a rope warping machine according to an exemplary embodiment in a top view.

In the following detailed description of preferred embodiments of the present disclosure a warping machine for a rope or rope warping machine according to the disclosure for warping or winding a rope 3 is generally indicated by the reference number 1. Referring to FIG. 1, where a schematic diagram of a rope warping machine 1 according to the disclosure is shown in a top view, the rope 3 comprises a plurality of yarns 5 bundled, twisted, braided and/or wrapped together, wherein in a preferred embodiment each yarn 5 comprises a plurality of fibers 7, particularly made of cotton, bundled, twisted, braided and/or wrapped together. In the following, it will exemplarily be made reference to a preferred embodiment of the disclosure where each yarn 5 comprises of a plurality of fibers 7. The cotton fibers 7 are bundled, twisted, braided and/or wrapped together to form a yarn 5 which is wound onto a spool (not illustrated). According to the present rope warping machine 1, a warp creel (not illustrated) is provided for supporting a plurality of such yarn spools and from which the yarns are unwound in order to being supplied or fed into a warping station 11 comprising a bobbin 9.

The yarns 5 are delivered to a comb or reed 13 in an essentially parallel manner along essentially the entire width of the comb 13, preferably horizontally. The comb 13 includes a plurality of comb wires (not illustrated) that are preferably elliptical in shape. The elliptical comb wires ensure less abrasion on the yarns 5 and arrange the single yarns 5 in a way that the yarns 5 are separated from each other and essentially evenly distributed over the width of the comb 13.

After leaving the comb 13, the yarns 5 are delivered in accordance with a feeding direction (F) to a bundling station 15 where the plurality of yarns 5 are bundled, twisted, braided and/or wrapped together to form the rope 3. The bundling station 15 can be a braiding device, particularly a horn gear braider, which interlaces the plurality of yarns to form the rope. Alternatively, the bundling station 15 can be designed as a particularly funnel-shaped feedthrough for bringing the plurality of yarns 5 together to form a dense compound having a particularly circular shaped cross-section.

Figure 3:
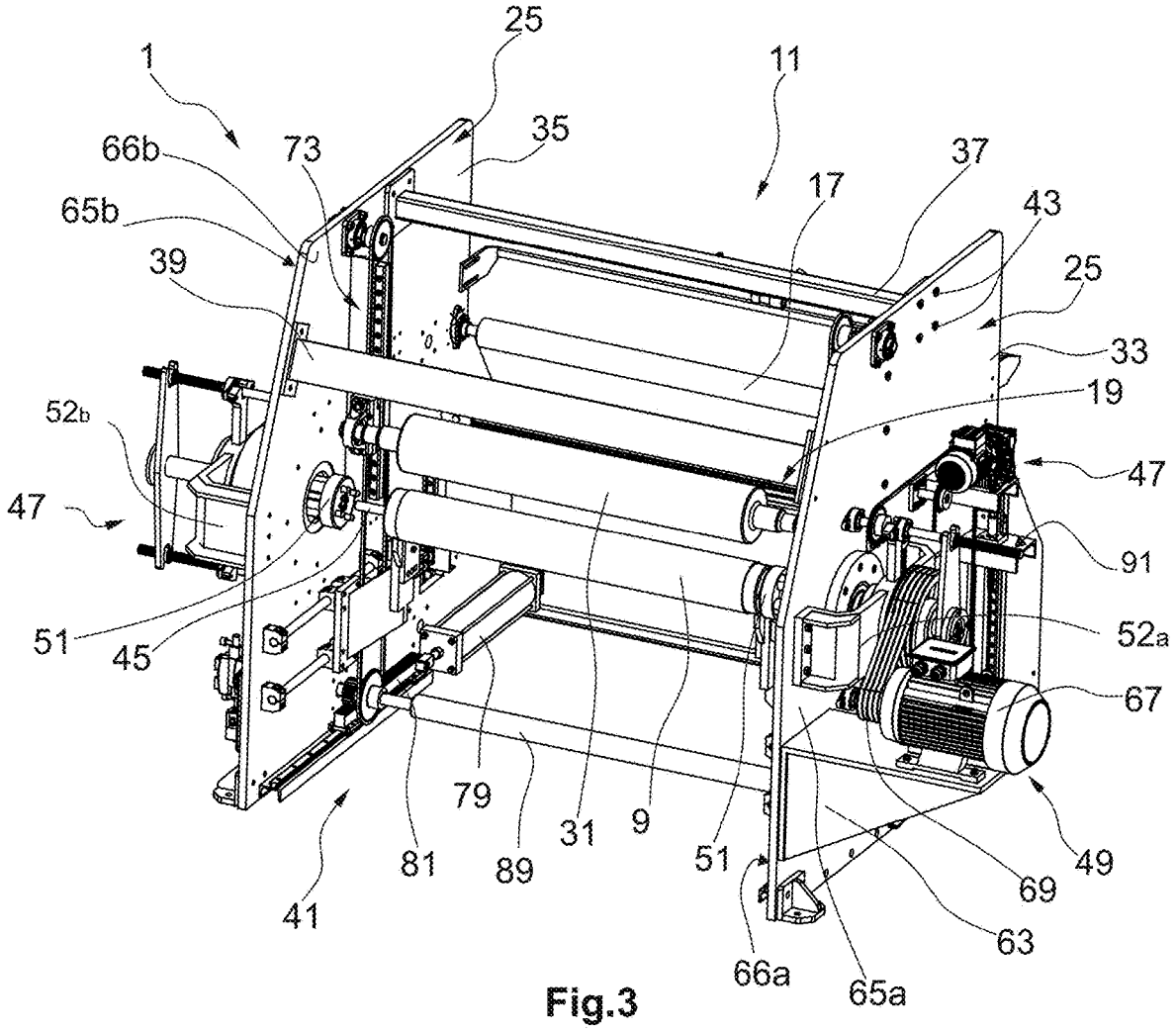
FIG. 3 shows a perspective view of the rope warping machine according to an exemplary embodiment with the rope not being illustrated.

Via a drum or roll 17 which is rotatably mounted on a frame structure 25, which will be dealt with in relation to FIG. 3, the rope 3 is advanced to the warping station 11. The warping station 11 comprises a rope guide 19, known as a traveler in the related technical field, arranged upstream said bobbin 9 and movably supported with respect to the bobbin for guiding the rope 3 along a warping with of the bobbin, preferably for guiding the rope 3 in a direction transverse to a conveying direction of the rope 3 and essentially along a width of the bobbin 9 in order to evenly distribute the rope 3 along the entire width of the bobbin 9 during the warping process. The rope guide 19 is supported on the frame structure 25 and comprises a bar or rail 23 on which a slide 21 for receiving and guiding the rope 3 can move, particularly glide or slide, in a direction transverse to the conveying direction of the rope 3, preferably horizontally.

Figure 2:
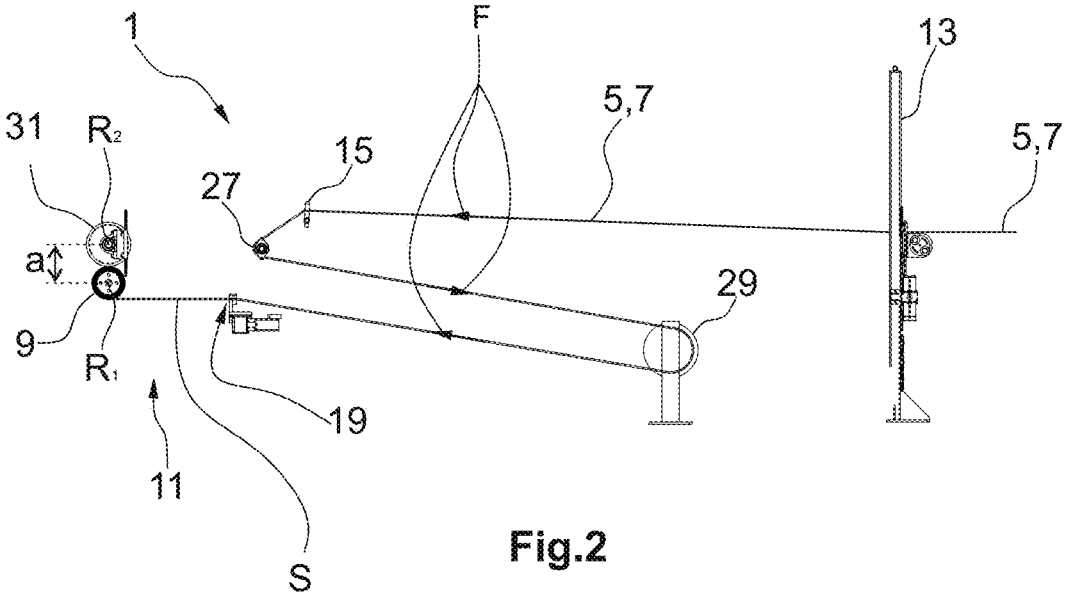
FIG. 2 shows a schematic diagram of the rope warping machine according to FIG. 1 in a side view.

With reference to FIG. 2, after leaving the bundling station 15 the rope 3 can pass idle rolls 27, 29 arranged for tensioning the rope 3 along its length and for providing a certain increased length of rope material which is ready for warping. Particularly, the idle rolls 27, 29 are located upstream the bundling station 15 and downstream the rope guide 19.

A pressure drum 31 arranged for applying a pressure onto the rope and/or for being in pressure contact with the rope 3 warped onto the bobbin 9 is rotatably mounted on the frame structure 25. In a preferred embodiment of the disclosure, the bobbin 9 is essentially circular shaped wherein particularly the longitudinal or axial extension of the bobbin 9 is bigger than its radial extension. In an alternative embodiment, the bobbin 9 comprises a cone or frustum shape wherein the radius of the bobbin 9 changes along the longitudinal, axial extension. According to the disclosure, a linear contact shall be provided between a peripheral surface of the bobbin 9 and a peripheral surface of the pressure drum 31 particularly essentially along the entire longitudinal extension, respectively width of the bobbin 9, preferably along the entire warping width on the bobbin. Therefore, a geometric shape of the bobbin 9 and a geometric shape of the pressure drum 31 are aligned with respect to each other such that, particularly in case of a cone shaped bobbin 9, the pressure drum 31 is complementarily shaped in order to provide a linear contact along the entire width of the bobbin. This means that, when the radius of the bobbin 9 increases and respectively reduces along its axial extension, the diameter of the pressure drum 31 reduces and increases along its axial extension. Preferably, the bobbin 9 and the pressure drum 31 have the same longitudinal, axial extension. In a preferred embodiment, a rotational bobbin axis R1 and a rotational drum axis R2 are parallel, spaced to each other and coplanar. In an exemplary embodiment according to FIG. 2, the pressure drum 31 is positioned exactly vertically above the bobbin 9 wherein a radial, particularly vertical, offset a between the rotational bobbin axis R1 and the rotational drum axis R2 is determined according to the radius of the bobbin 9 and the radius of the pressure drum 31. It shall be clear, that the offset a is at least as big as the sum of the radius of the bobbin 9 and the radius of the pressure drum 31.

Particularly with regards to FIG. 2, it can be seen that the rope guide 19 is arranged in a vertical height which corresponds to a lowermost position of the bobbin 9, wherein the lowermost position is defined by the largest distance from the rotational bobbin axis R1. Therefore, a rope section, defining a feed string (S), between the rope guide 19 and the bobbin 9 is oriented essentially horizontally such that the rope 3 engages the bobbin 9 at a 6 o'clock position on the circumference of the bobbin 9.

Referring to FIGS. 3 to **6*b*, the disclosure will be described in more detail, wherein for the purpose of illustration, the rope 3 is not shown. In FIG. 3, the rope warping machine 1, particularly its warping station 11 is illustrated in a perspective view. A machine frame or frame structure 25 is provided for supporting further components of the warping station 11 on the ground, the frame structure 25 comprising preferably two sidewalls 33, 35 of preferably essentially identical shape preferably being arranged opposite and parallel to each other. The sidewalls 33, 35 are configured as metal plates, particularly iron or steel plates, and are connected with each other via at least one supporting bar 37 for reinforcing the frame structure 25, which is preferably arranged at the top of the sidewalls 33, 35 in order to not interfere the winding of the rope 3. Another reinforcement rib 39 can be provided for further strengthening the frame structure 25 preferably arranged at a front side 41 of the working station 11, the front side 41 being the upstream side with respect to the conveying direction of the rope 3. In order to facilitate the attachment of components on the frame structure 25, the sidewalls 33, 35 comprise a plurality of bores 43, particularly through holes, designed for receiving connection parts, such as screws. Exemplarily regarding the bobbin 9, it can be seen in FIG. 2 that the bobbin 9 is arranged in between the sidewalls 33, 35 and preferably mounted on the inner surfaces 66***a*, 66*b* of the sidewalls 33, 35, the inner surfaces 66*a*, 66*b* pointing to each other. Analogously, the pressure drum 31 and/or the rope guide 19 can be mounted on the inner surfaces 66*a*, 66*b* of the sidewalls 33, 35.

The preferably cylindrical bobbin 9 is mounted preferably adjacent the front side 41 of the warping station 11. The bobbin 9 comprises a drive shaft 45 coaxially with the rotational bobbin axis R1, wherein the drive shaft 45 axially protrudes the bobbin 9 in order to engage with an engagement device 47 for coupling the bobbin 9 with a drive 49 in order to drive, respectively rotate, the bobbin 9 around the rotational bobbin axis R1. The engagement device 47 is further provided for mounting the bobbin 9 on the frame structure 25 and for interlocking with the bobbin 9 in a way that a drive force generated by the drive 49 is transmitted to the bobbin 9. For this purpose, the engagement device 47 comprises an interlock 51, such as a wheel hub or a clutch, configured to engage the bobbin 9, respectively the drive shaft 45 of the bobbin 9, at an end face 53 of the bobbin 9. For example, the end face 53 of the bobbin 9 can comprise at least one nub 55 for engaging a corresponding notch 57 provided in the engagement device 47, respectively the wheel hub. In an alternative embodiment, the bobbin 9 can comprise notches 57 and the wheel hub can comprise nubs 55. When the engagement device 47 contacts the bobbin 9 in an operating position of the working station 11, a relative movement between the bobbin 9 and the wheel hub of the interlocking device 47 is prevented. Particularly a relative rotational movement is prevented such that the entire drive force generated by the drive 49 is transmitted to the bobbin 9 in order to provide an efficient warping operation. Another function of the engagement device 47 is to allow for the bobbin 9 to be removed from the working station 11 after the warping process is finished. For this purpose a motor 59 can be coupled to a transmission 61, preferably a chain gear or a belt drive, which allows for a movement of the wheel hub in essentially the longitudinal or axial direction of the bobbin 9. For engaging respectively disengaging the wheel hub 59 from the bobbin 9, the motor 59 generates a preferably rotational force for driving the chain or belt of the transmission 61. In order to transfer the rotational movement of the chain or belt, another transmission, particularly a rack and pinion drive, is provided for moving the wheel hub away from the bobbin 9. In a preferred embodiment, at least one ball screw 91 is coupled to the wheel hub in a way that a rotation of a shaft 93 of the ball screw 91 leads to a linear movement of the wheel hub in an axial direction of the bobbin 9 in order to engage respectively disengage the wheel hub from the bobbin 9. Preferably, the interlock is designed for being moved in an axial direction of the bobbin in order to engage respectively disengage the bobbin, wherein preferably a surface of the interlock facing a rope-free surface of the bobbin is configured to engage the rope-free surface in order to provide a form-fitting force transmission. Alternatively, the rope free surface of the bobbin and the surface of the interlock facing the rope free surface are configured to frictionally engage each other in the manner of the coupling or a clutch for transmitting the drive force. In this case, the rope free surface and the surface of the interlock facing the bobbin are arranged parallel to each other and are of preferably identical shape, wherein particularly a coating can be provided on at least one of the surfaces for increasing a friction coefficient.

As explained above, the drive force for rotationally driving the bobbin 9 is generated by the drive 49 supported on the frame structure 25 (FIG. 4*a*, 4*b*). In particular, the drive 49 is supported on the frame structure 25 via a preferably L-shaped profile 63 being fixedly mounted on one of the outer surfaces 65*a*, 65*b* of the sidewalls 33, 35 (FIG. 3). Said arrangement allows for an easy access to the drive 49 in case of maintenance or replacement. Additionally, carrying frame sections 52*a*, 52*b* are provided for attaching the drive 49 to the frame structure 25, particularly to both sidewalls 33, 35 of the frame structure 25. The carrying frame sections 52*a*, 52*b* comprise preferably a U-shape in a top view in order to surround parts of the drive 49. In a preferred embodiment according to FIGS. 4*a*, 4*b*, the drive 49 is provided exclusively at one axial side of the bobbin 9, wherein on the other axial side of the bobbin 9, a mounting 50 is provided which is part of the engagement device 47 for engaging/disengaging the bobbin 9. Still referring to FIG. 4*a*, 4*b*, the drive 49 comprises a motor 67, particularly a pneumatically actuated motor, more preferably a servo motor, coupled to a belt transmission 69 which is in turn coupled to the engagement device 47 in order to drive the bobbin, wherein a preferable bobbin rotating direction B is indicated by the curved arrow in FIG. 4*a*. In a preferred embodiment of the disclosure a roll 71 of the belt transmission 69 receives and engages the belt of the transmission. The roll 71, the wheel hub of the engagement device 47 and the bobbin 9, respectively the drive shaft 45 of the bobbin 9, are arranged coaxially with respect to each other such that they share a common rotational axis, particularly the rotational axis R1. Further, a regulating electronics (not illustrated) can be provided for controlling the rotating speed of the bobbin 9, respectively the drive force generated by the drive 49. For example, the regulating electronics is designed to align the rotational speed of the bobbin 9 with the increasing warp thickness on the bobbin 9 due to the increasing number of layers of rope 3 wound onto and surrounding the bobbin 9. Particularly, the rotational speed of the bobbin goes up if the warp thickness on the bobbin increases. Further, an operation program can be deposited on the regulating electronics for automatically performing the warping operation, wherein the operation program can be based on input data relating among others to the length of the rope 3, respectively the length of the yarns 5 and fibers 7, the diameter of the bobbin 9, and the distance between the warping station 11 and the warp creel.

Referring now to FIG. 5*a*, 5*b* the structure and functioning of a guiding device 73 for moving the rope guide 19 and the pressure drum 31 will be described in detail. During the warping operation, preferably a constant pressure that acts on the rope 3 warped on the bobbin 9 is required to smoothen the peripheral surface of the bobbin 9 and to press the layers of rope 3 wound onto the bobbin 9 together in order to reduce the rope thickness on the bobbin 9. For this purpose, at least one pressure drum 31 is provided for applying a pressure onto the rope warped onto the bobbin and/or for being in pressure contact with the rope 3 warped onto the bobbin 9. As explained above, the pressure drum 31 is rotatably mounted on the frame structure 25. Further, the pressure drum 31 is translationally movably mounted on the frame structure 25 in a way that the rotational drum axis R2 is movable with regard to the rotational bobbin axis R1, respectively with regard to the frame structure 25, in order to follow the increasing warp thickness on the bobbin 9, preferably to compensate the increasing warp thickness. For this purpose, the pressure drum 31 is guided by a carriage-rail-arrangement which comprises a carriage 75 which is able to move relatively to a bar or a rail 77 being formed by the support structure 25 or being fixedly attached to the frame structure 25. In a preferred embodiment, no motor is provided for moving the pressure drum 31 radially with regards to the bobbin 9. The relative movement of the pressure drum 31 away from the bobbin 9 is therefore caused only by the increasing rope thickness 3 on the bobbin 9 pushing away the drum 31. In an alternative embodiment, an additional motor (not illustrated), particularly a pneumatically actuated drive system, is provided. This leads to the advantage that a preferably constant pressure of particularly 2 bar acting from the pressure drum 31 to the bobbin 9 can be generated and maintained during the warping operation. It shall be clear, that any relative movement of the bobbin 9 and the pressure drum 31 where the rotational drum axis R2 is moved relatively to the stationary rotational bobbin axis R1 falls under the scope of the disclosure. For example, the relative movement of the pressure drum 31 with respect to the bobbin 9 is defined by a radial direction of the bobbin 9.

In a preferred embodiment, a controller 74 (FIG. 5*b*) can be coupled to the guiding device 73. The controller 74 is configured to regulate the movement of the pressure drum 31, particularly to ensure a constant pressure of particularly 2 bar acting on the rope 3 warped onto the bobbin 9. The guiding device 73, particularly the motor of the guiding device 73 for moving the pressure drum 31, further facilitates the assembly and the disassembly of the bobbin 9 before every warping operation respectively after the warping operation is finished because the pressure drum 31 can be displaced from the bobbin 9 such that the bobbin 9 is easy to access.

The preferably pneumatically actuated drive system can comprise at least one pneumatic cylinder 79. Preferably, two pneumatic cylinders 79 being coupled to the same servo drive can be provided, wherein each of the pneumatic cylinders 79 is mounted on one of the sidewalls 33, 35, particularly on different sidewalls 33, 35. Each of the pneumatic cylinders 79 is coupled to a rack 81 being part of a transmission, such as a rack and pinion gear 83, in order to move the rack 81 by a pneumatic force. The rack and pinion gear 83 comprises a plurality of pinions 85 designed for rolling alongside the racks 81 and for engaging with a chain or belt which is provided for transmitting the pneumatic force of the at least one pneumatic cylinder 79 to the pressure drum 31, particularly to transfer the linear movement of the rack 81 into a linear movement of the pressure drum 31 relative to the rotational bobbin axis R1. Said relative linear movement of the pressure drum 31 allows the pressure drum 31 to follow the increasing warp thickness on the bobbin 9. In order to couple a first part of the rack and pinion gear 83 being arranged at one of the sidewalls 33, 35 with a second part of the rack and pinion gear 83 being arranged at the other of the sidewalls 33, 35, a freely turning connection roll 89 is provided, which axial end faces are each fixedly connected to a corresponding pinion 85 being turned by virtue of the movement of the corresponding rack 81. Therefore, it is ensured that both parts of the rack and pinion gear 83 perform the same movement so that the pressure drum 31 is evenly moved. A chain 87 is connected to the carriage 75 supporting the pressure drum 31 in a way that the movement of the chain 87 causes a movement of the carriage 75 relative to the frame structure 25, respectively of the pressure drum 31.

In a preferred embodiment, the pressure drum 31 is preferably exclusively rotated due to a frictional engagement with the driven bobbin 9, preferably due to a frictional engagement between the peripheral drum surface and the peripheral bobbin surface, is the bobbin 9 being rotated by the drive 49. In order to achieve said force transmission, the pressure drum 31 needs to be rotatably mounted on the frame structure 25, wherein preferably the pressure drum is at idle, which means that no separate of further drive respective motor correlates to the pressure drum 31. Therefore, it is advantageous that the rope 3 warped onto the bobbin 9 does not grind on the peripheral surface of the pressure drum 31 which would lead to a damage of the rope 3. Preferably, no slip exists between the rotational movement of the bobbin 9 and the rotational movement of the pressure drum 31 such that the friction and the abrasion of the rope 3 is minimized. According to a preferred embodiment of the disclosure, the rotational movement of the pressure drum 31 is achieved only via the frictional contact with the driven bobbin 9. Conclusively, the drum rotating direction is opposite to the preferred rotating direction B of the bobbin 9. It shall be clear that when speaking of the relative movement of the pressure drum 31 with respect to the rotational bobbin axis R1, reference is made to the relative movement of the corresponding rotational axes and not to a relative rotational movement.

According to a further aspect of the disclosure, the at least one pneumatic cylinder 79 is also coupled to the rope guide 19 being movably supported on the frame structure 25. Analogously, a rack and pinion gear can be provided for transmitting the pneumatic force generated by the at least one pneumatic cylinder 79 to the rope guide 19 in order to move the rope guide 19 with respect to the frame structure 25 and with respect to the bobbin 9. For this purpose, the bar 23 is movable along a guide 24 fixedly attached to the support structure 25 in a direction transverse, particularly essentially perpendicular, with regard to the plane defined by the conveying direction of the feed string (S) and the rotational bobbin axis 9. The guide 24 is oriented in an essentially vertically manner in order to allow for a vertical movement of the rope guide 19 with regard to the frame structure 25 and the bobbin 9. It is an advantage of the present disclosure that only one drive is needed because said arrangement of one preferably pneumatically actuated drive system is coupled to the pressure drum 31 and the rope guide 19. A further advantage of said arrangement is that the movement of the pressure drum 31 and the movement of the rope guide 19 can be aligned with respect to each other. For example, a pneumatic force generated by the at least one pneumatic cylinder 79 can cause a movement of the same distance of the pressure drum 31 and the rope guide 19, particularly simultaneously. In another preferred embodiment, the distance covered by the movement of the pressure drum 31 respectively the rope guide 19 can be different from each other and/or defined by a predetermined clocking. In a preferred embodiment, the movement of the pressure drum 31 and the movement of the rope guide 19 are aligned with respect to each other in a way that the pressure drum 31 and the rope guide 19 move in opposing directions, preferably opposing vertical directions. In each case, both of the pressure drum 31 and the rope guide 19 follow the increasing warp thickness on the bobbin 9.

With regard to FIG. 5*b*, two time points during a warping operation are shown wherein the time t2 preferably being the end of a warping operation, is later than the time t1, preferably being the start of the warping operation. In FIG. 5*b*, the positions of the rack 81 (indicated by t1", t2"), the rope guide 19 (indicated by t1', t2') and the pressure drum 31 (indicated by t1, t2) are each shown. It can be seen that when the pneumatic force generated by the at least one pneumatic cylinder 79 causes the rack 81 to move, such as to the left as in FIG. 5*b*, the rotation of the pinions 85 engaging the chain 87 lead to a relative movement of the pressure drum 31, respectively vertically upwards, and to a relative movement of the rope guide 19, respectively vertically downwards, with respect to the frame structure 25. In particular with regards to FIG. 2, it shall be clear that during the warping operation the warp thickness on the bobbin 9 increases due to an increasing number of layers of rope 3 being warped onto the bobbin 9. It is therefore necessary for the pressure drum 31 of being able to relatively move in a direction radial away from the rotational bobbin axis R1 in order to maintain a constant pressure of preferably 2 bar on the rope 3 warped onto the bobbin 9. Further, a relative movement of the rope guide 19 in a direction radial away from the rotational bobbin axis R1 is required so that no additional tension is applied to the rope 3. Conclusively, less friction and less damage to the rope 3 is caused.

In a preferred embodiment, the rope guide 19 is positioned with respect to the bobbin 9 in a way that the rope guide 19 is located at a radial most distant position with respect to the rotational bobbin axis R1, wherein the most distant position is defined by the largest radius of the bobbin 9. Referring to FIGS. 2 and 5*b*, the rope guide 19 is positioned at a vertically lowermost position defined by the diameter of the bobbin 9 such that when the warp thickness on the bobbin 9 increases due to an increasing number of layers of rope 3 surrounding the bobbin 9, the rope guide 19 moves radially vertically downwards with respect to the rotational bobbin axis R1. Again referring to FIG. 2, due to said radial movement of the rope guide 19 in a vertical direction with respect to the bobbin 9, it is ensured that the rope section between the rope guide 19 and the bobbin 9 is constantly oriented essentially horizontally and particularly constantly engages the bobbin 9 at a 6 o'clock position on the circumference of the bobbin 9. It shall be clear that other arrangements of the bobbin 9, the pressure drum 31 and the rope guide 19, which fulfill the objective of the present disclosure are also covered by the teachings disclosed herein.

The features disclosed in the above description, the figures and the claims may be significant for the realization of the disclosure in its different embodiments individually as in any combination.

REFERENCE LIST

1 warping machine
3 rope
5 yarns
7 fibers
9 bobbin
11 warping station
13 comb
15 bundling station
17 roll
19 rope guide
21 slide
23 bar
24 guide
25 support structure
27, 29 idle roll
31 pressure drum
33, 35 sidewall
37 supporting bar
39 reinforcement rib
41 front side
43 bore
45 drive shaft
47 engagement device
49 drive
50 mounting
51 interlock
52*a, b* carrying frame section
53 end face
55 nub
57 notch
59, 67 motor
61 transmission
63 1-profile
65*a, b* outer surface
66*a, b* inner surface
69 belt transmission
71 roll
73 guiding device
75 carriage
77 rail
79 pneumatic cylinder
81 rack
83 rack and pinion gear
85 pinion
87 chain
89 connection roll
91 ball screw
a offset
B bobbin rotating direction
F feeding direction
R1 rotational bobbin axis
R2 rotational drum axis
S feed string
Pos. (t1) position of the pressure drum at the time t1
Pos. (t2) position of the pressure drum at the time t2
Pos. (t1') position of the traveler at the time t1
Pos. (t2') position of the traveler at the time t2
Pos. (t1") position of the pinion at the time t1
Pos. (t2") position of the pinion at the time t2

The invention claimed is:

1. A warping machine for a rope made of a plurality of yarns, comprising:

a support structure;

a bobbin onto which said rope is warped, the bobbin being mounted on the support structure and configured to rotate around a rotational bobbin axis;

a pressure drum rotatably mounted on the support structure and configured to rotate around a rotational drum axis and to apply pressure onto the rope warped onto the bobbin, wherein the rotational bobbin axis is stationarily supported with regard to the support structure and the rotational drum axis is translationally movably mounted on the support structure so that the pressure drum follows an increasing warp thickness on the bobbin;

a drive configured to rotationally drive the bobbin around the rotational bobbin axis, wherein the pressure drum is mounted at idle for freely turning around its rotational drum axis and the bobbin is arranged between the drive and the pressure drum such that the bobbin transfers rotational driving forces of the drive to the pressure drum; and an engagement device including an interlock configured to couple the drive to the bobbin, the interlock being fixedly connected to the drive, wherein the interlock forms a force introduction point configured to engage with a bobbin force transmission point including a ball screw configured to guidingly move the interlock along the rotational bobbin axis to engage and disengage the bobbin.

2. The warping machine according to claim 1, further comprising: a carriage-rail-arrangement configured to guide the pressure drum, and including a carriage and a rail, the carriage configured to move relative to the rail or to a channel formed by said support structure, wherein the carriage-rail-arrangement is configured to force the carriage to follow a predetermined guiding direction.

3. The warping machine according to claim 2, wherein the pressure drum is coupled to a pneumatically actuated drive system configured to cause the pressure drum to apply a constant pressure onto the bobbin and/or the rope warped onto the bobbin, wherein the drive system cooperates with the carriage such that the pressure drum follows an increasing warp thickness on the bobbin and simultaneously applies pressure onto the bobbin, the pressure being directed opposite to the increasing warp thickness, respectively the movement of the carriage.

4. The warping machine according to claim 3, further comprising a controller that is connected to the drive system, the controller being configured to regulate an amount of pressure being applied onto the bobbin such that, by following the increasing warp thickness on the bobbin, the pressure drum applies the constant pressure onto the bobbin and/or the rope warped onto the bobbin, wherein the controller is configured to automatically regulate the pressure amount based on input data relating to warping machine characteristics.

5. The warping machine according to claim 3, further comprising a pneumatic cylinder and a transmission, which is a rack and pinion gear, coupled to the drive and configured to transmit a pneumatic force generated by the pneumatic cylinder to the pressure drum, wherein the rack and pinion gear includes a rack connected to the pneumatic cylinder and cooperating with a pinion configured to roll alongside the rack and a chain rolling alongside the pinion, the rack being linearly moved by the pneumatic force such that the pinion is rotationally driven by the rack and the chain is rotationally driven based on the rotation of the pinion, wherein the chain is fixedly connected with the carriage to translationally move the pressure drum.

6. The warping machine according to claim 1, wherein the drive comprises:

a motor configured to generate a drive force; and a belt drive transmission configured to transmit the drive force from the motor to the bobbin, wherein the bobbin is configured to transfer the drive force to the pressure drum to rotate the pressure drum around the rotational drum axis by friction, the transmission of the drive force being performed by a frictional contact between a peripheral bobbin surface and a peripheral drum surface such that a bobbin rotating direction is directed opposite to a drum rotating direction.

7. The warping machine according to claim 6, wherein the interlock is fixedly connected to the transmission of the drive.

8. The warping machine according to claim 1, wherein:

the force introduction point is defined by a nub formed on a surface of the interlock facing the bobbin and configured to engage with a corresponding notch defining the bobbin force transmission point, or a notch formed on a surface of the interlock facing the bobbin and configured to engage with a corresponding nub defining the bobbin force transmission point, in order to provide a form-fitting force transmission, and/or a contact surface of the bobbin and a surface of the interlock facing the contact surface of the bobbin are configured to frictionally engage each other to form a drive force transmission coupling.

9. The warping machine according to claim 1, further comprising:

a rope guide arranged upstream of the bobbin and movably supported with respect to the bobbin on the support structure to reciprocate and guide the rope along a warping width of the bobbin, wherein the rope guide is further movably supported with respect to the bobbin to move away from the bobbin to follow an increasing warp thickness on the bobbin.

10. The warping machine according to claim 9, wherein the rope guide is moved away from the bobbin such that a feed string of the rope, between the rope guide and the bobbin, includes a constant orientation with regard to the support structure and/or remains in a horizontal plane.

11. The warping machine according to claim 9, further comprising:

a pneumatically-actuate drive that is configured to move the rope away from the bobbin; and a common drive system for the rope guide and the pressure drum, movement of the rope guide and movement of the pressure drum being synchronized with respect to each other such that the rope guide and the pressure drum: move in opposing radial directions with regard to the rotational bobbin axis, follow a predetermined clocking, move simultaneously, and/or move along a same distance.

12. The warping machine according to claim 9, wherein the rope guide comprises a bar mounted to the support structure and a slide configured to receive and reciprocate the rope along the warping width of the bobbin such that the slide is relatively moved with regard to the bar, wherein the bar is translatory movable along a guide attached to the support structure to move away from the rotational bobbin axis and to define a predetermined translatory moving direction for the rope guide.

13. The warping machine according to claim 11, wherein the synchronization of the movement of the rope guide and movement of the pressure drum is performed such that a rotational movement of a chain connected with a carriage supporting the pressure drum is correlated with a translatory movement of the pressure drum and the rope guide, wherein the chain is further connected with the bar corresponding to the rope guide, the carriage and the bar being arranged at the chain such that a rotational turning point of the chain is positioned between the carriage and the bar to translationally move the carriage and the bar into different directions.

14. The warping machine according to claim 3, wherein the constant pressure is 1.5 bar to 2.5 bar.

15. The warping machine according to claim 4, wherein the warping machine characteristics include a length of the rope and/or a diameter of the bobbin.

16. A warping machine for a rope made of a plurality of yarns, comprising:

a support structure;

a bobbin onto which said rope is warped, the bobbin being mounted on the support structure and configured to rotate around a rotational bobbin axis;

a pressure drum rotatably mounted on the support structure and configured to rotate around a rotational drum axis and to apply pressure onto the rope warped onto the bobbin;

a drive configured to rotationally drive the bobbin around the rotational bobbin axis, wherein the pressure drum is mounted at idle for freely turning around its rotational drum axis and the bobbin is arranged between the drive and the pressure drum such that the bobbin transfers rotational driving forces of the drive to the pressure drum; and an engagement device including an interlock configured to couple the drive to the bobbin, the interlock being fixedly connected to the drive, wherein the interlock forms a force introduction point configured to engage with a bobbin force transmission point including a ball screw configured to guidingly move the interlock along the rotational bobbin axis to engage and disengage the bobbin.

17. A warping machine for a rope made of a plurality of yarns, comprising:

a support structure;

a bobbin onto which said rope is warped, the bobbin being mounted on the support structure and configured to rotate around a rotational bobbin axis;

a pressure drum rotatably mounted on the support structure and configured to rotate around a rotational drum axis and to apply pressure onto the rope warped onto the bobbin;

a rope guide arranged upstream of the bobbin and movably supported with respect to the bobbin on the support structure to reciprocate and guide the rope along a warping width of the bobbin, wherein the rope guide is further movably supported with respect to the bobbin to move away from the bobbin to follow an increasing warp thickness on the bobbin;

a drive configured to rotationally drive the bobbin around the rotational bobbin axis, wherein the pressure drum is mounted at idle for freely turning around its rotational drum axis and the bobbin is arranged between the drive and the pressure drum such that the bobbin transfers rotational driving forces of the drive to the pressure drum; and an engagement device including an interlock configured to couple the drive to the bobbin, the interlock being fixedly connected to the drive, wherein the interlock forms force introduction point configured to engage with a bobbin force transmission point including a ball screw configured to guidingly move the interlock along the rotational bobbin axis to engage and disengage the bobbin.

* * * * *